US005970630A

United States Patent [19]

Gallegos

[11] Patent Number: 5,970,630

[45] **Date of Patent: *Oct. 26, 1999**

[54] RIGID MIDSOLE FOOTWARE STRUCTURE WITH REMOVABLE UNDERCARRIAGE ATTACHING MEANS

[76] Inventor: Alvaro Z. Gallegos, Rte. 9 - Box 160, Santa Fe, N.Mex. 87505

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,643

[22] Filed: Sep. 11, 1996

Related U.S. Application Data

[63] Continuation-in-part of application No. 08/428,840, Apr. 25, 1995, abandoned, which is a continuation-in-part of application No. 08/178,839, Jan. 7, 1994, abandoned.

[51] Int. Cl.[6] ..... A43B 3/24; A43B 21/36; A43C 13/00

[52] U.S. Cl. ..... 36/100; 36/15; 36/36 R; 36/42; 36/36 B; 36/102

[58] Field of Search ..... 36/15, 30 R, 31, 36/100, 101, 36 R, 42, 36 B, 102, 92, 93, 88

[56] References Cited

U.S. PATENT DOCUMENTS

| | | | |
|---|---|---|---|
| 1,341,387 | 5/1920 | Schrade . | |
| 1,506,315 | 8/1924 | Lywitzki . | |
| 1,986,727 | 1/1935 | Hall, Jr. | 36/36 B |
| 2,168,606 | 8/1939 | Movsesian | 36/42 |
| 2,239,600 | 4/1941 | Fogarty . | |
| 2,345,551 | 4/1944 | Audino | 36/31 |
| 2,361,511 | 10/1944 | Stritter | 36/31 |
| 2,707,341 | 5/1955 | Romano . | |
| 2,734,288 | 2/1956 | Phillips et al. . | |
| 2,760,280 | 8/1956 | Carlin . | |
| 2,837,841 | 6/1958 | Twedt . | |
| 2,873,540 | 2/1959 | Murphy . | |
| 3,199,233 | 8/1965 | Steinbock | 36/93 |
| 3,318,025 | 5/1967 | Antelo . | |
| 3,389,481 | 6/1968 | England . | |
| 3,432,945 | 3/1969 | Cesta . | |
| 3,464,126 | 9/1969 | Sarkissian . | |
| 3,478,447 | 11/1969 | Gillead | 36/36 B |
| 3,608,213 | 9/1971 | Jensen . | |
| 3,646,497 | 2/1972 | Gillikin . | |
| 3,952,429 | 4/1976 | Thomas | 36/31 |
| 3,975,839 | 8/1976 | Taber . | |
| 3,982,336 | 9/1976 | Herro . | |
| 4,020,569 | 5/1977 | Fukuoka | 36/30 R |
| 4,124,946 | 11/1978 | Tomlin | 36/30 R |
| 4,214,384 | 7/1980 | Gonzalez . | |
| 4,348,821 | 9/1982 | Daswick | 36/30 R |
| 4,400,893 | 8/1983 | Musci . | |
| 4,409,745 | 10/1983 | Musci . | |
| 4,494,323 | 1/1985 | Latraverse . | |
| 4,510,702 | 4/1985 | Ehrlich, Jr. | 36/31 |
| 4,610,100 | 9/1986 | Rhodes . | |
| 4,805,320 | 2/1989 | Goldenberg et al. . | |
| 5,025,574 | 6/1991 | Lasher, III . | |
| 5,058,290 | 10/1991 | Koehl et al. . | |
| 5,133,138 | 7/1992 | Durcho . | |
| 5,347,730 | 9/1994 | Colon . | |
| 5,373,650 | 12/1994 | Dananberg et al. | 36/92 |
| 5,410,820 | 5/1995 | Goodman . | |
| 5,423,134 | 6/1995 | Bagnaia et al. | 36/101 |

FOREIGN PATENT DOCUMENTS

| | | | |
|---|---|---|---|
| 1059488 | 3/1954 | France . | |
| 1633161 | 12/1989 | France | 36/101 |
| 125350 | 4/1949 | Switzerland | 36/15 |

*Primary Examiner*—M. D. Patterson
*Attorney, Agent, or Firm*—Oliff & Berridge, PLC

[57] ABSTRACT

A rigid midsole structure for footwear extends from the metatarsal area to a rear-most portion proximate the heel of a wearer. The rigid midsole accepts any form of replaceable undercarriage structure, and includes means for attaching the undercarriage structure to the bottom side of the rigid midsole. The rigid midsole is preferably formed with an upper surface configured to conform with the bottom of a wearer's foot to provide sufficient rigidity and comfort.

48 Claims, 10 Drawing Sheets

RIGID MIDSOLE FOOTWARE STRUCTURE WITH REMOVABLE UNDERCARRIAGE ATTACHING MEANS

This application is a Continuation-in-Part of U.S. Ser. No. 08/428,840 filed Apr. 25, 1995 now abandoned, which in turn is a Continuation-in-Part of application Ser. No. 08/178,839 filed Jan. 7, 1994 now abandoned.

BACKGROUND OF THE INVENTION

The invention relates to a rigid midsole structure for footwear, such as shoes and boots. In particular, the rigid midsole structure is incorporated into footwear and is sufficiently rigid to provide an adequate, comfortable and total support for a wearer's foot. The rigid midsole extends from the general metatarsal area of a wearer's foot to the rearmost portion of the footwear. The rigid midsole is constructed to accept any form of undercarriage structure, and will include means for attaching any undercarriage structure.

Presently, footwear does not include a rigid midsole extending from the metatarsal area of a wearer to the rearmost portion of footwear and extending across the width of the foot, and thus existing footwear have some degree of flexibility. At most, known footwear have included stabilizers that merely extend over a portion of the width and only a portion of the length of footwear. This type of structure does not support the entire wearer's foot from the metatarsal area to the rear portion of the foot, and has been found to be uncomfortable due to its limited support of the foot.

SUMMARY OF THE INVENTION

Accordingly, it is an object of the invention to provide footwear having a rigid midsole structure that overcomes the disadvantages of existing footwear structures.

It is another object of the invention to provide footwear with a rigid midsole that provides a strong, comfortable and stable support for a wearer's foot.

It is a further object of the invention to provide a rigid midsole that is capable of having any type of undercarriage structure attached thereto at any position between the metatarsal area and the rear portion of the foot.

These and other objects of the invention are achieved by providing footwear having a rigid midsole structure, where the rigid midsole extends from a metatarsal area of a wearer to the rearmost portion of the footwear. Further, the rigid midsole includes means for attaching an undercarriage, regardless of the form of the undercarriage.

The objects and advantages of the invention may be realized and attained by the structure as set forth hereinafter. Other objects, advantages and salient features of the invention will become apparent in the following detailed description, which, taken in conjunction with the annexed drawings, discloses preferred embodiments of the invention.

BRIEF DESCRIPTION OF THE DRAWINGS

The invention will be described in detail with reference to the following drawings, in which like reference numerals refer to like elements and wherein.

DETAILED DESCRIPTION OF PREFERRED EMBODIMENTS

Figure 1:
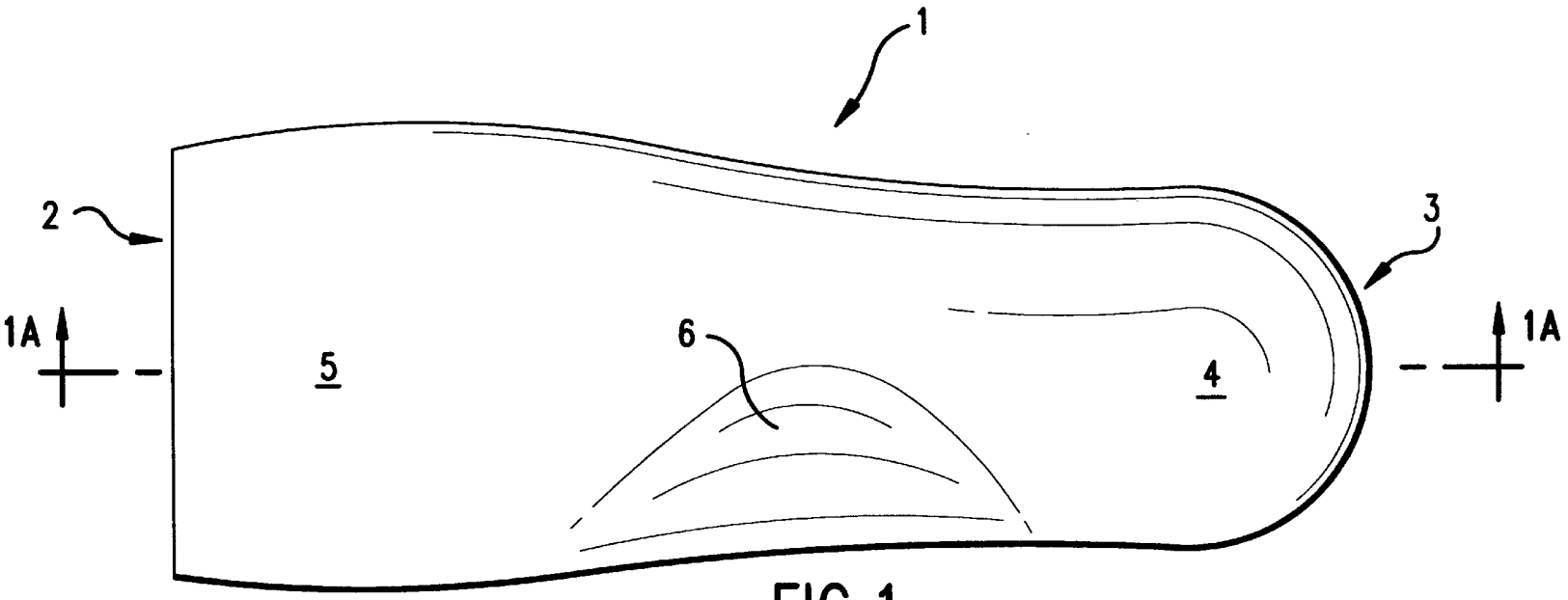
FIGS. 1, 1A and 1B illustrate a rigid midsole according to one embodiment of the invention.
Figure 1A:
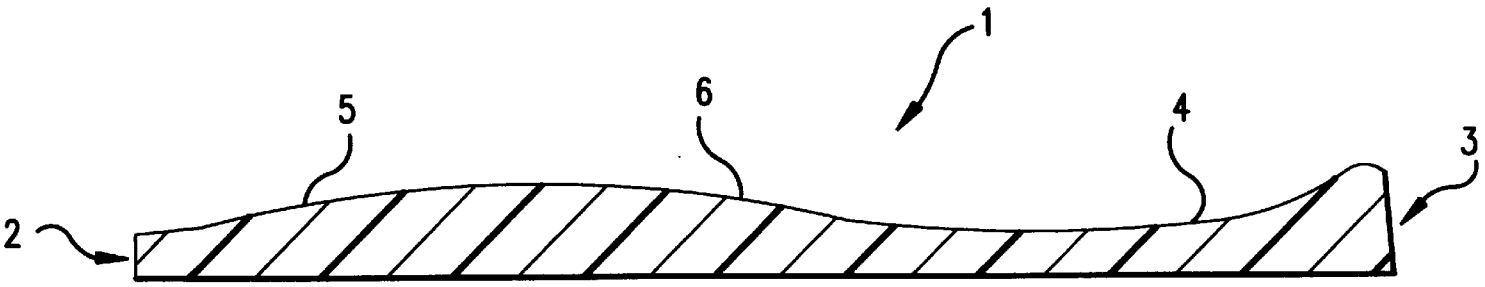
Figure 11:
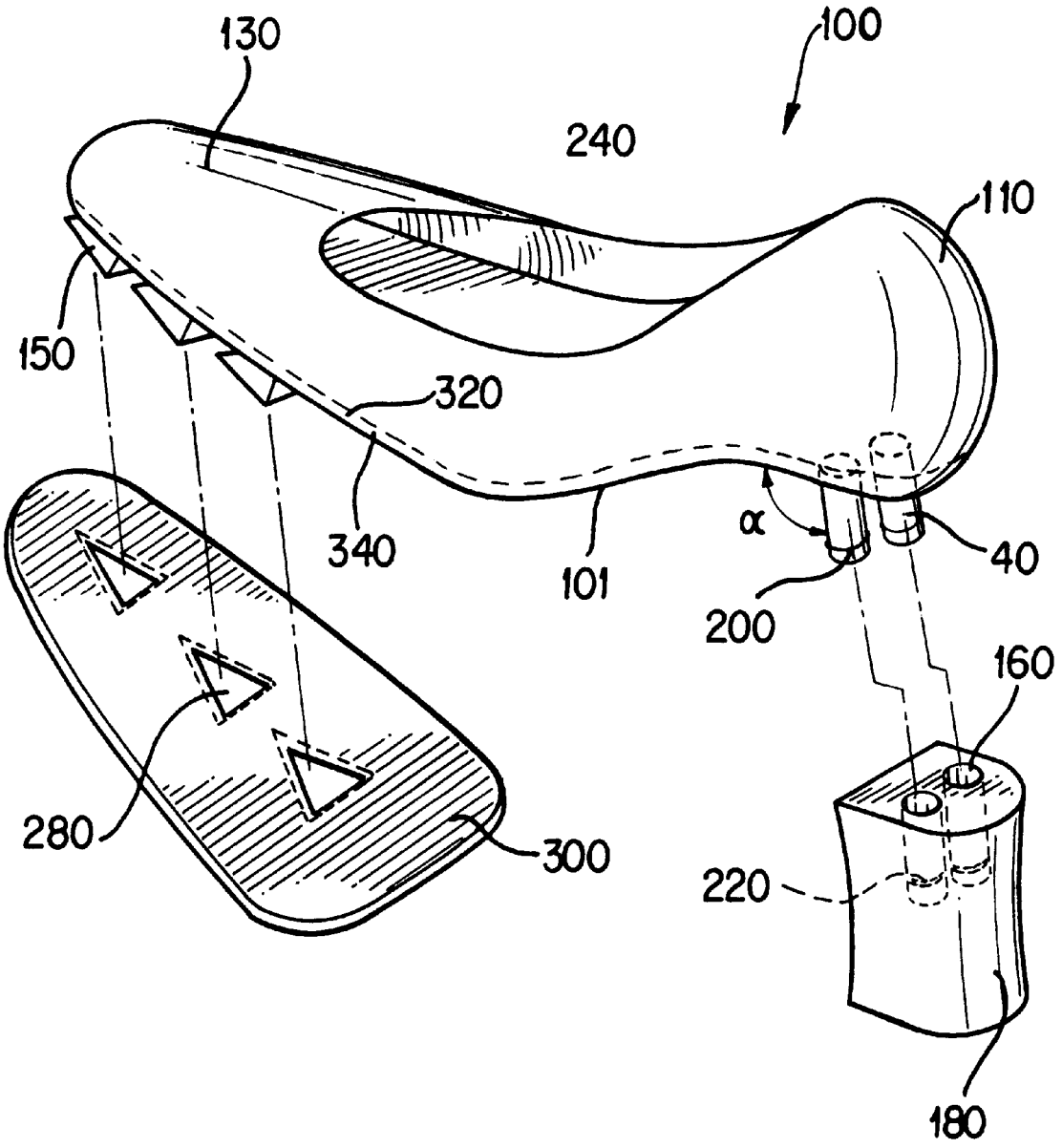
FIG. 11 is a perspective view showing a removable heel and sole in a footwear equipped with a rigid midsole.

FIGS. 1 and 1A are a general illustration of a rigid midsole according to the invention. The rigid midsole 1 is incorporated into a footwear of any type so as to extend from a metatarsal area of a wearer's foot (see, for example, element 25 in FIG. 2, referencing the joint between the rear part of the toes and the main part of the foot, generally known as the ball of the foot), to the rearmost portion of the footwear generally proximate the heel. Preferably, the rigid midsole is a generally or substantially planar piece, as shown in FIG. 1A. However, the rigid midsole can also be bent, as shown in FIG. 11.

The front portion 2 of the rigid midsole 1 is attached to a front sole 26 (FIG. 2) that is positioned under the toes of a wearer and extends forwardly from the metatarsal area of the foot.

Figure 1B:
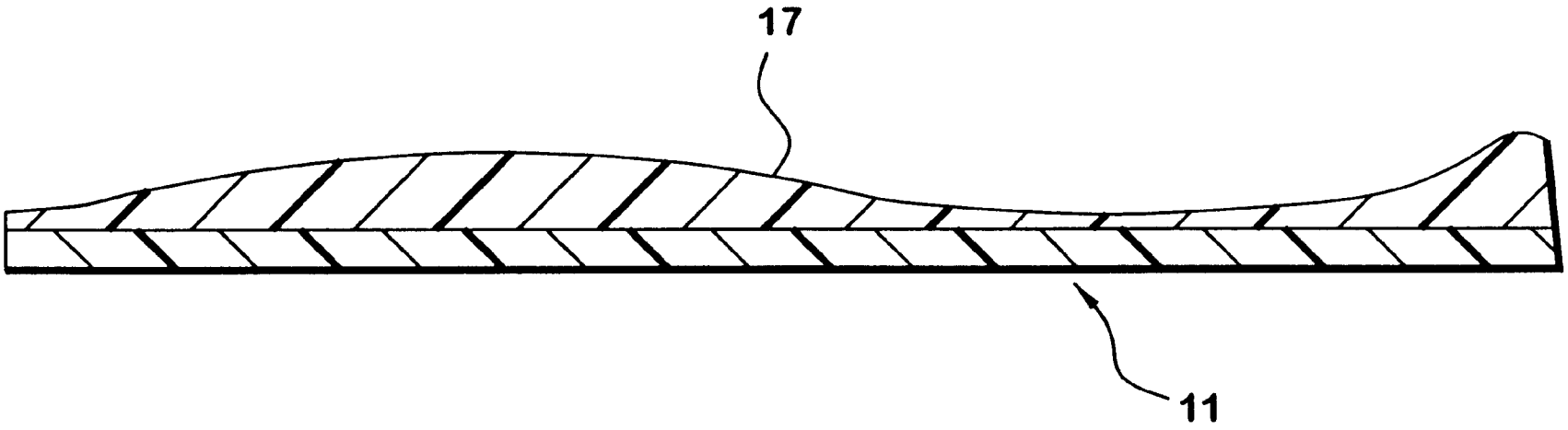

The rear portion 3 of the rigid midsole 1 terminates at the rear of the footwear to support the heel of a wearer. As can be seen in FIG. 1A, the rigid midsole 1 preferably is configured as a single piece (by integral molding, machining or otherwise) with a contour matching the bottom of a person's foot. The rigid midsole thus preferably includes a depression region 4 to receive the heel of a wearer. The mid-portion of the rigid midsole 1 then preferably includes a raised region 6 to support the arch of a wearer. Further, the rigid midsole 1 preferably includes a ramped or downwardly sloping inclined region 5 which leads from the arch to the metatarsal area at a front of a foot. As a person of ordinary skill in the art would recognize, the dimensions and positioning of the depression area 4, the inclined area 5 and the raised arch area 6 can be specifically designed to match a single wearer's foot. Alternatively, the midsole can be formed to provide generally accepted dimensions of the depression 4, raised arch area 6 and inclined area 5 for most feet. It is also possible to make the rigid midsole generally flat, as shown at 11 in FIG. 1B, with a separate, contoured foot support or insole 17 attached thereto by gluing or fastening means.

The rigid midsole 1 is structured from any suitable material, as long as the material is rigid, allows attachment of an undercarriage (to be discussed hereinafter) and provides a firm support for a wearer's foot. For example, the rigid support may be made out of plastic; composite materials; hardened rubber, natural or synthetic; metal; reinforced polymers; any other equivalent material; or a combination of these materials. These materials are merely descriptive, and are not meant to limit the invention in any way.

Figure 2:
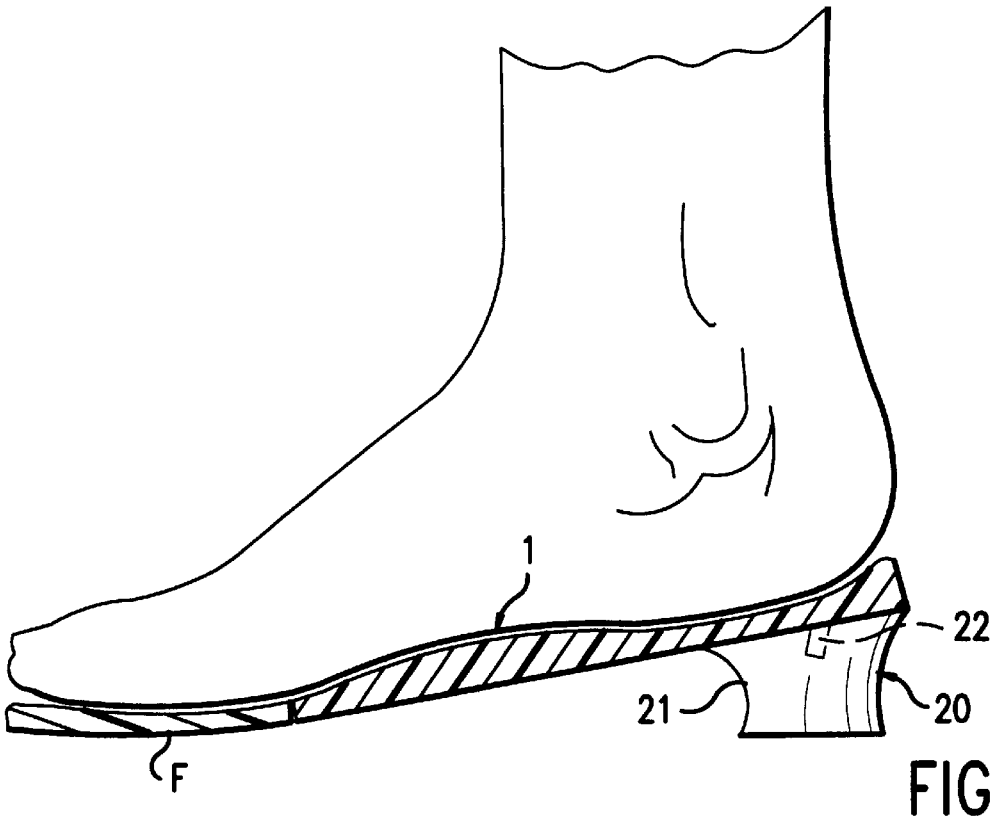
FIG. 2 illustrates footwear having a rigid midsole with a replaceable undercarriage in the form of a multiple stud-receiving heel.

FIG. 2 illustrates a rigid midsole with a replaceable undercarriage 20. The replaceable undercarriage 20 includes a replaceable heel 21. Preferably, the replaceable heel 21 is attached to the midsole using multiple studs 22 (as described hereinafter especially with respect to FIGS. 11–14). However, appropriate alternative means may be used to attach the replaceable heel 21 to the rigid midsole 1, for example a single stud, wedge or wedges, glue, snaps, velcro or the like (as described hereinafter). The selected means may be integral with the rigid piece or separate from the rigid piece.

Figure 3:
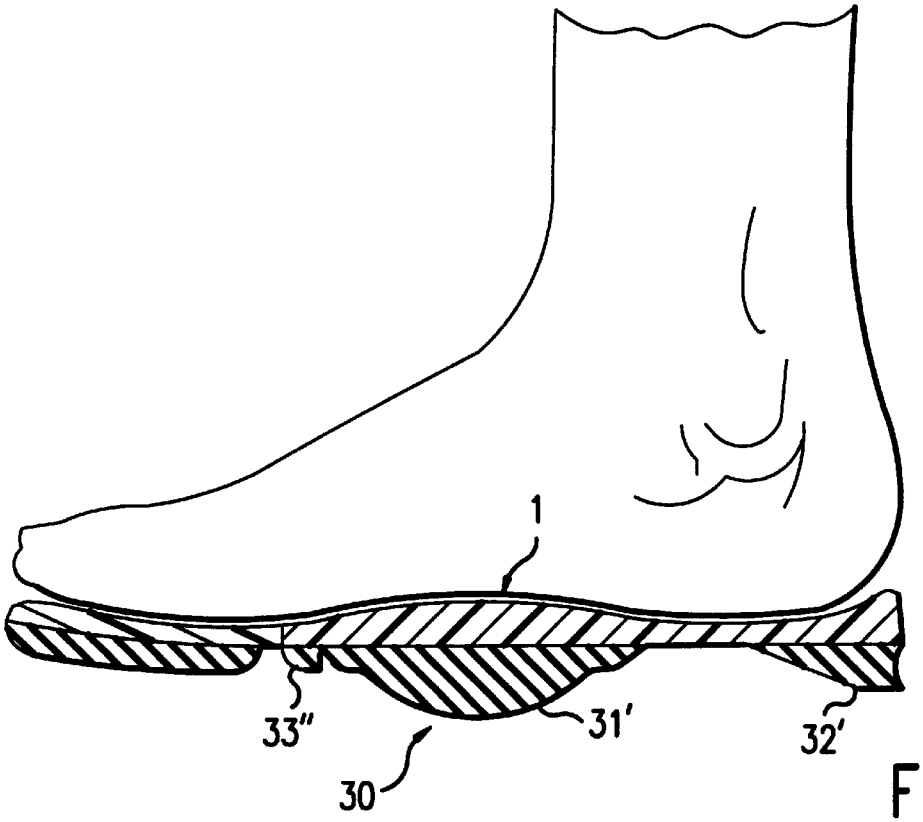
FIG. 3 illustrates footwear having a rigid midsole with a replaceable multipiece undercarriage.

FIG. 3 illustrates a rigid midsole 1 with a replaceable undercarriage 30. The replaceable undercarriage 30 is a multi-component undercarriage that is designed for a rolling walking action of the user. The replaceable undercarriage 30 comprises a plurality of components 31–33, which can be attached by any suitable means. For example, components 31–33 of the replaceable undercarriage 30 may be attached to the rigid midsole 1 by means of studs or wedges, as discussed hereinafter with respect to FIGS. 11–14. Alternatively, velcro, bolts or any other suitable means may be used to attach the components.

Figure 4:
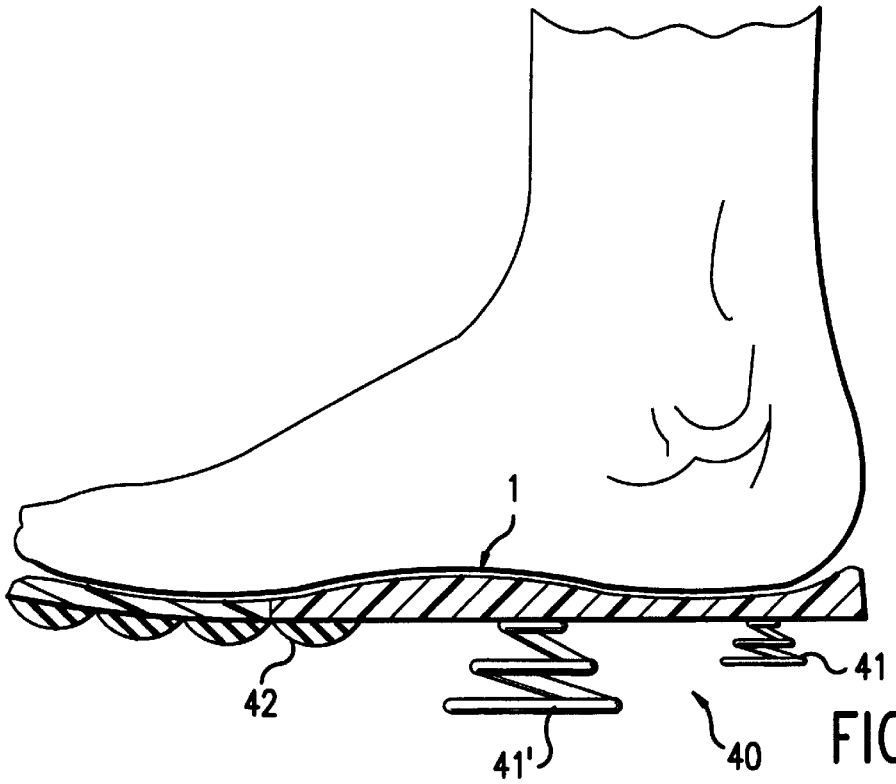
FIG. 4 illustrates footwear having a rigid midsole with a replaceable undercarriage for an athletic-type running footwear.

FIG. 4 illustrates a running-type athletic footwear structure with a replaceable undercarriage attached to the rigid midsole 1. The replaceable undercarriage 40 may include any number of components 41, 42 and 43, all of which may take any form. In particular, FIG. 4 illustrates the replaceable undercarriage comprising one or more spring-type undercarriage components 41 and 42. These replaceable spring-type undercarriage components 41 and 42 may be attached by any appropriate means, including a bolt or other similar fastener, to the rigid undercarriage. Further, the replaceable undercarriage 40 includes a resilient undercarriage component 43 positioned proximate the metatarsal area of the wearer. The resilient undercarriage component 43 provides for additional cushioning of the metatarsal area during use, especially during running. The resilient undercarriage component 43 may be attached by any appropriate means, for example by wedges, glue, snaps, velcro or the like (as discussed hereinafter).

Figure 5:
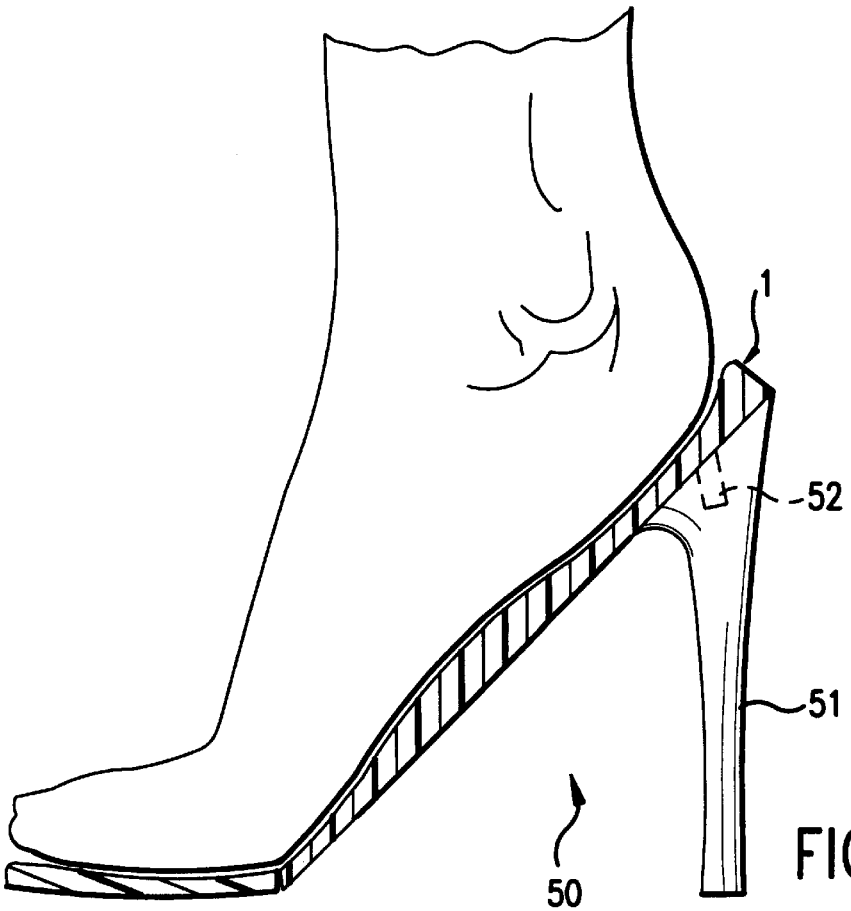
FIG. 5 illustrates footwear having a rigid midsole with a replaceable undercarriage in the form of a multiple stud-receiving dress heel.

FIG. 5 illustrates a rigid midsole 1 incorporated in a dress heel footwear structure. The replaceable undercarriage 50 includes a replaceable heel 51, which may be of any appropriate shape, height and/or design. Preferably, the replaceable heel 51 is attached to the rigid midsole 1 by multiple studs 52, as illustrated. However, any appropriate means of attachment of the replaceable heel 51 to the rigid midsole 1 may be used. The replaceable heel 51 permits the dress heel footwear to have its heel 51 replaced and exchanged for a heel of another height, color, fashion and/or design, in accordance with the preference of a wearer.

Figure 6:
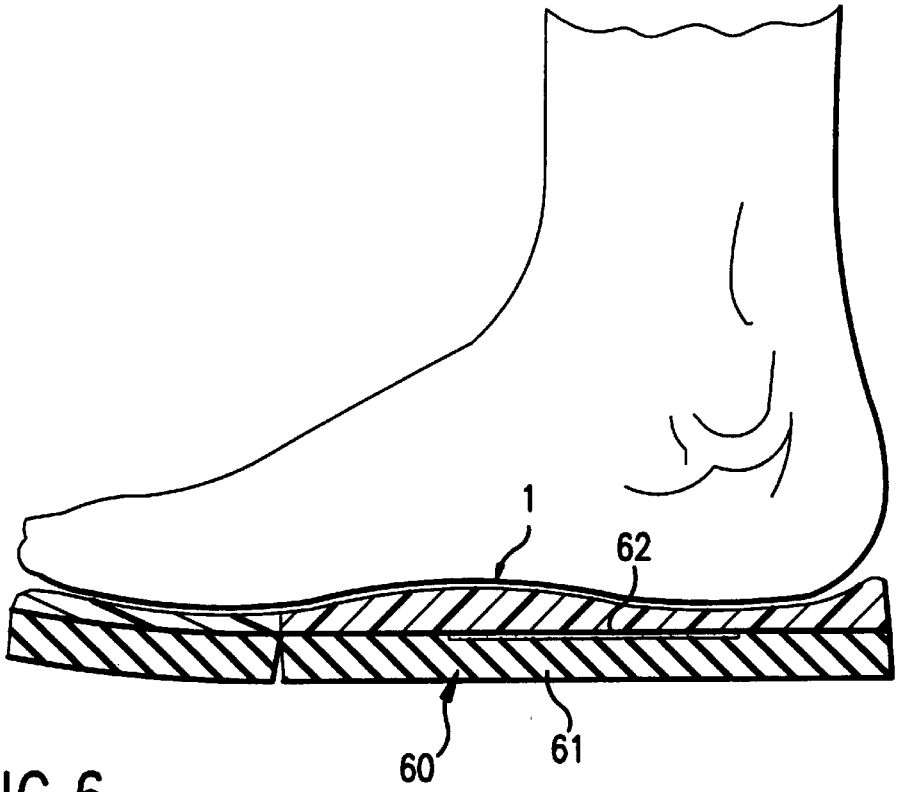
FIG. 6 illustrates footwear having a rigid midsole with a replaceable, flexible, resilient undercarriage.

FIG. 6 illustrates a rigid midsole 1 incorporated in a comfortable, everyday-type footwear, such as a loafer, lace-up or other type. The replaceable undercarriage 60 includes resilient undercarriage component 61, which can be attached by any appropriate means to the midsole 1, for example by wedges or studs (as discussed hereinafter) or a removable adhesive or velcro 62, as illustrated. The resilient undercarriage component 61 is preferably constructed from a comfortable resilient material, which provides additional cushioning and balance for a wearer. For example, the resilient undercarriage component 61 may be formed of silicon, rubber, either natural or synthetic, or other flexible resilient material. The resilient undercarriage component 61 provides additional comfort and balance for a wearer.

Figure 7:
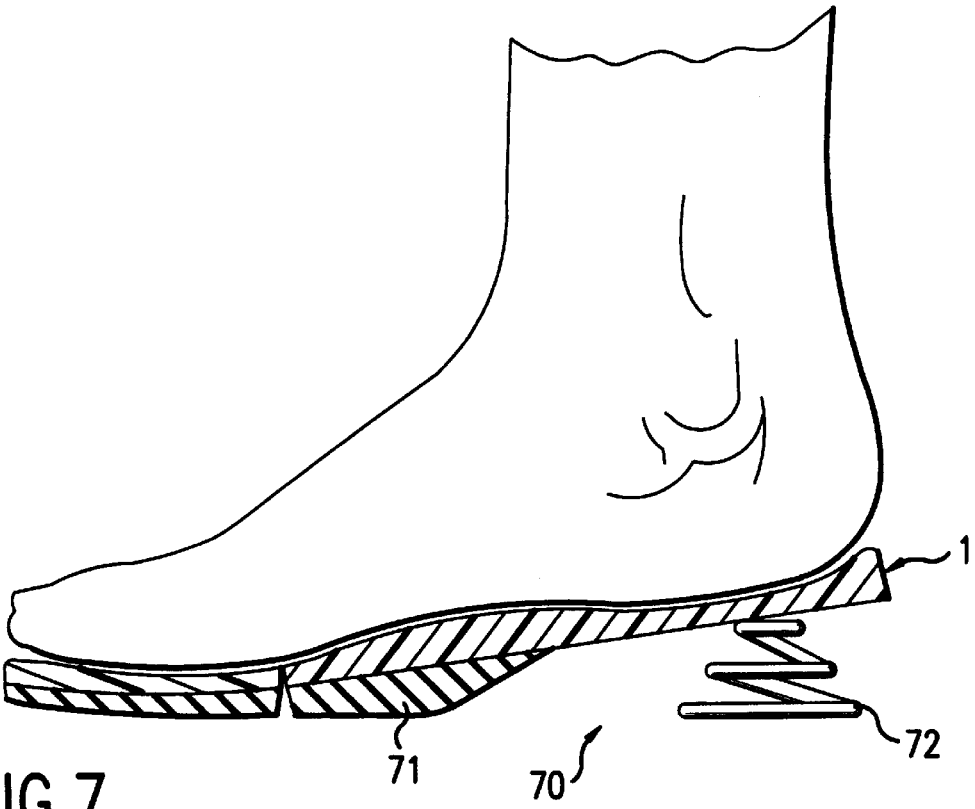
FIG. 7 illustrates footwear having a rigid midsole with a replaceable multipiece undercarriage including a spring heel.

FIG. 7 illustrates a rigid midsole 1 incorporated into footwear having a multi-component replaceable undercarriage 70. For example, as illustrated in FIG. 7, the replaceable undercarriage includes a spring heel component 72 and a replaceable undercarriage component 71. The replaceable undercarriage component 71 is proximate the metatarsal area of the wearer. The spring heel component 72 is proximate the heel and may be attached to the rigid midsole 1 by any appropriate means, such as, for example, a bolt, screw or other fastener or fasteners. The replaceable undercarriage component 71 may be attached to the rigid midsole in any appropriate manner, such as the various ways described herein.

Figure 8:
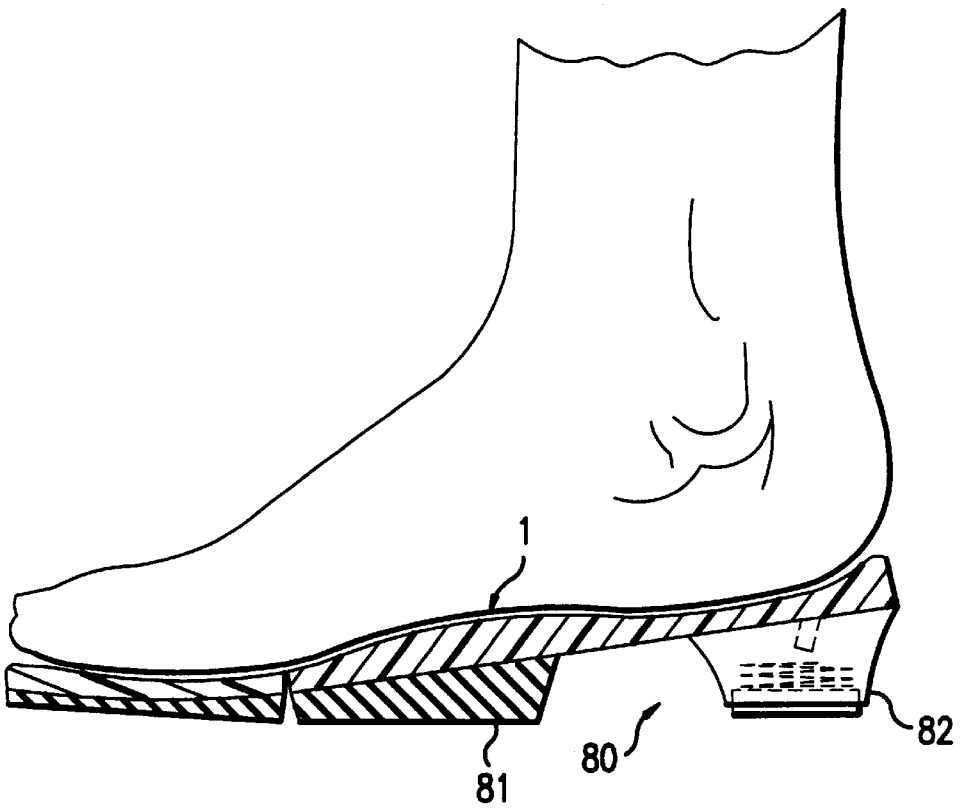
FIG. 8 illustrates footwear having a rigid midsole with a replaceable undercarriage in the form of a utility undercarriage that includes a wedge and a multiple stud-receiving spring heel.

FIG. 8 illustrates a further footwear using the rigid midsole 1. In FIG. 8, the footwear includes the rigid midsole 1 and a multi-component replaceable undercarriage 80. The multi-component replaceable undercarriage may comprise a replaceable heel 82 attached to the rigid midsole by multiple studs or by other appropriate means described herein. Further, the multi-component replaceable undercarriage 80 in FIG. 8 includes a replaceable wedge component 81, which can be formed of any appropriate material. The wedge component 81 is positioned between the arch and metatarsal area of the wearer to provide additional support for the wearer when using the heel 82. Since the replaceable heel 82 may be replaced with a heel of differing height (as discussed above), the wedge component 81 is similarly replaceable with another wedge component having a height corresponding to the height of the replaceable heel 82.

Figure 9:
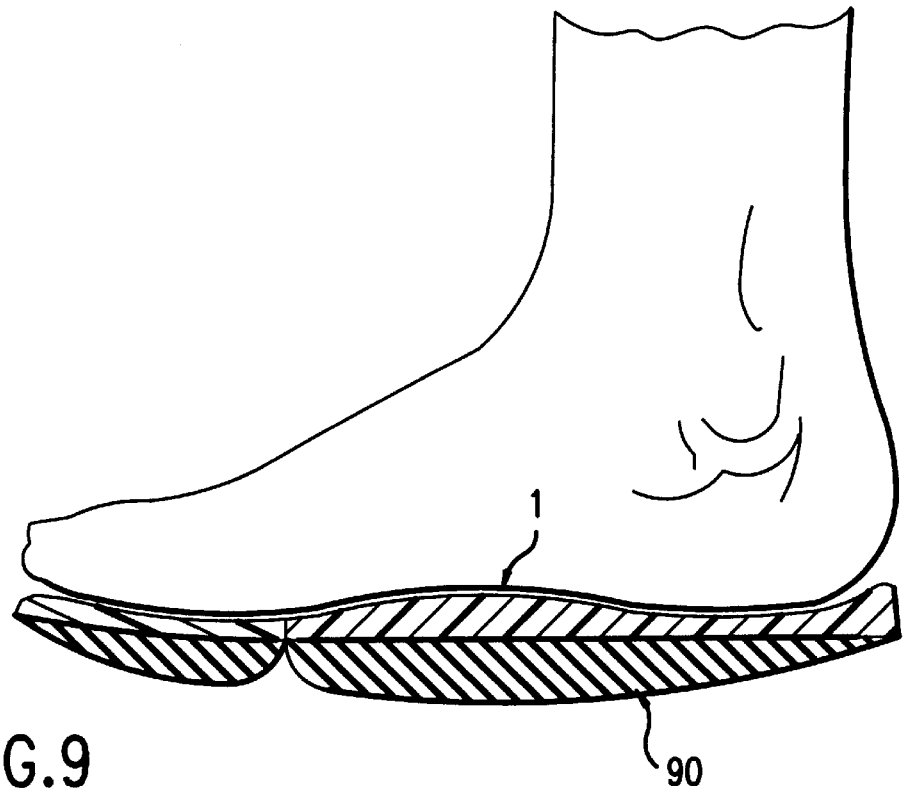
FIG. 9 illustrates footwear having a rigid midsole with a replaceable undercarriage for a walking footwear.

FIG. 9 is a further embodiment comprising the rigid midsole in a walking-type footwear. In FIG. 9, a replaceable undercarriage 90 is attached to the rigid midsole 1. The replaceable undercarriage 90 comprises replaceable undercarriage component 91 and may be attached by any appropriate means, as discussed above. The replaceable undercarriage component 91 is formed with a curved arcuate bottom portion to provide a roll for the wearer when walking. The replaceable undercarriage component 91 can be formed of any material, hard or soft.

Figure 10:
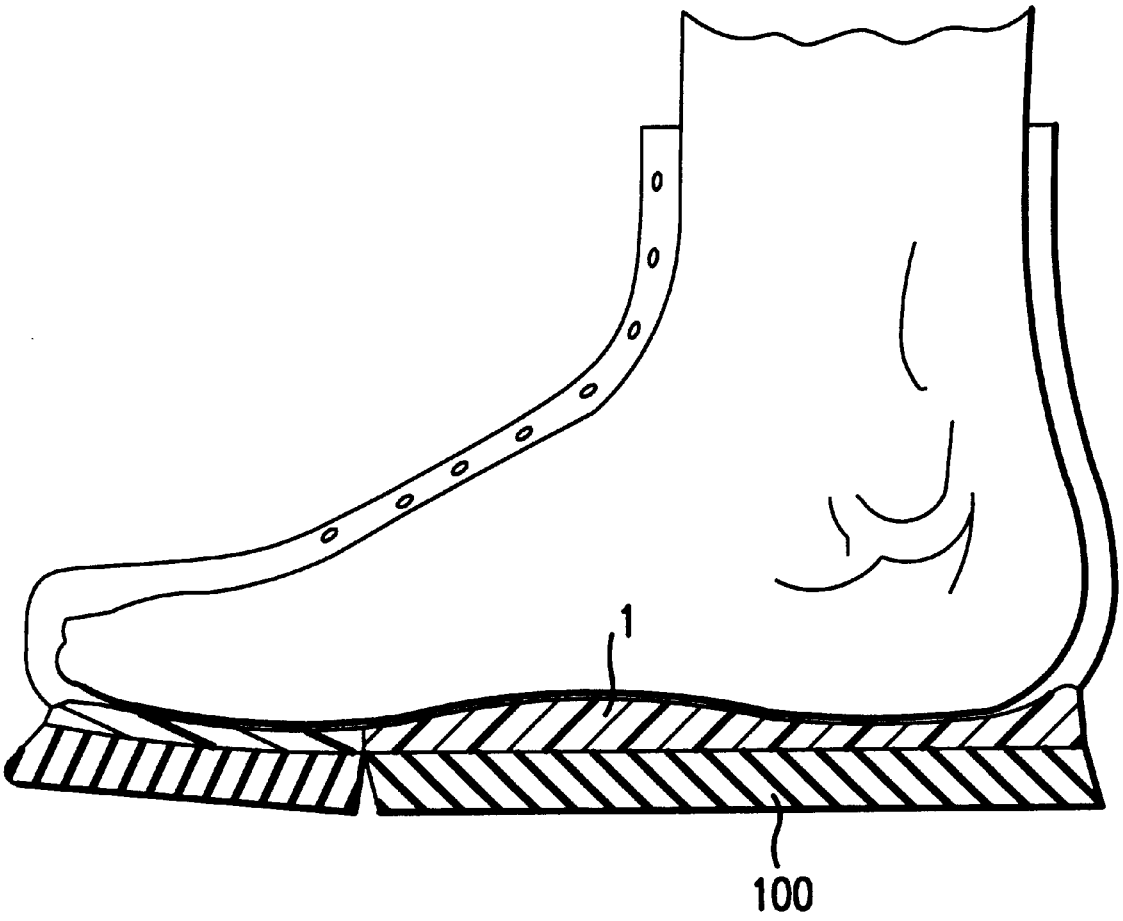
FIG. 10 illustrates footwear having a rigid midsole with a replaceable undercarriage for a "high-top" footwear.

FIG. 10 is an illustration of a high-top type footwear, for example, a sneaker, boot, work boot, hiking boot or the like. The replaceable undercarriage 100 comprises replaceable undercarriage component 101, which is attached to the rigid midsole 1 by any appropriate means, such as a wedge or stud attachment, velcro or removable adhesive, as discussed above. The replaceable undercarriage component 101, as well as the other undercarriages discussed above, may have a tread appropriate for the intended terrain, and may be replaced depending on the terrain. For example, the tread of the replaceable undercarriage may comprise studs or cleats if the footwear it to be used on a turf, may include a deep tread design if the footwear is to be used in hiking over uneven terrain, or may include any other appropriate tread structure.

While the embodiments have discussed particular means of attachment of the replaceable undercarriage to the rigid midsole, the invention is not limited to the particular attachment means described. For example, the replaceable undercarriage may be attached to the rigid midsole by magnetic means, if the rigid midsole 1 includes a metal and/or is constructed, at least in part, from a magnet and the replaceable undercarriage includes metal and/or magnetic portions. Further, other means of attachment of the replaceable undercarriage are possible, as long as the rigid midsole supports the wearer's foot from the metatarsal area to the rear portion of the foot. Further, the undercarriage may be of any form, shape, design or material, dependent on the ultimate intended use of the footwear.

Referring to FIG. 11, the footwear can comprise removable sole(s) and heel(s). A foot support portion 1000 is divided into a front area 1300 and a rear area 1100. Front and rear areas 1300, 1100 preferably include toe support portion 1500 and heel support portion (rigid midsole) 1001, respectively. Preferably, heel support portion 1001 of rear area 1100 has fixed thereto a pair of stud members 1400 adapted to be received in a corresponding pair of stud receiving apertures 1600 in one of a plurality of heels 1800. Studs 1400 are fixed to heel support portion 1001 by glue or the like or are molded integrally to heel support portion 1001.

Studs 1400 are secured in apertures 1600 by a friction fit and preferably include snapping ridge members 2000 that are engageable with radial protrusions 2200 in apertures 1600. Alternatively, members 2000 may be radial crevices in studs 1400 for receiving radial protrusions 2200. Still further, snapping ridge members 2000 may engage radial crevices in apertures 1600. Of course, many variations of the attachment between studs 1400 and apertures 1600 will be contemplated by those of ordinary skill in the art based on this disclosure, and the illustrated embodiments are not meant to be limiting.

Studs 1400 are disposed at an angle $\alpha$ relative to heel support portion 1001 of foot support portion 1000. Angle $\alpha$ is preferably in the range of 60°–80°, and is most preferably about 70°. Angle $\alpha$ of studs 1400 enables the footwear to better retain and accommodate a wide variety of heels having a wide variety of heights (see FIGS. 13 and 14).

Figure 12:
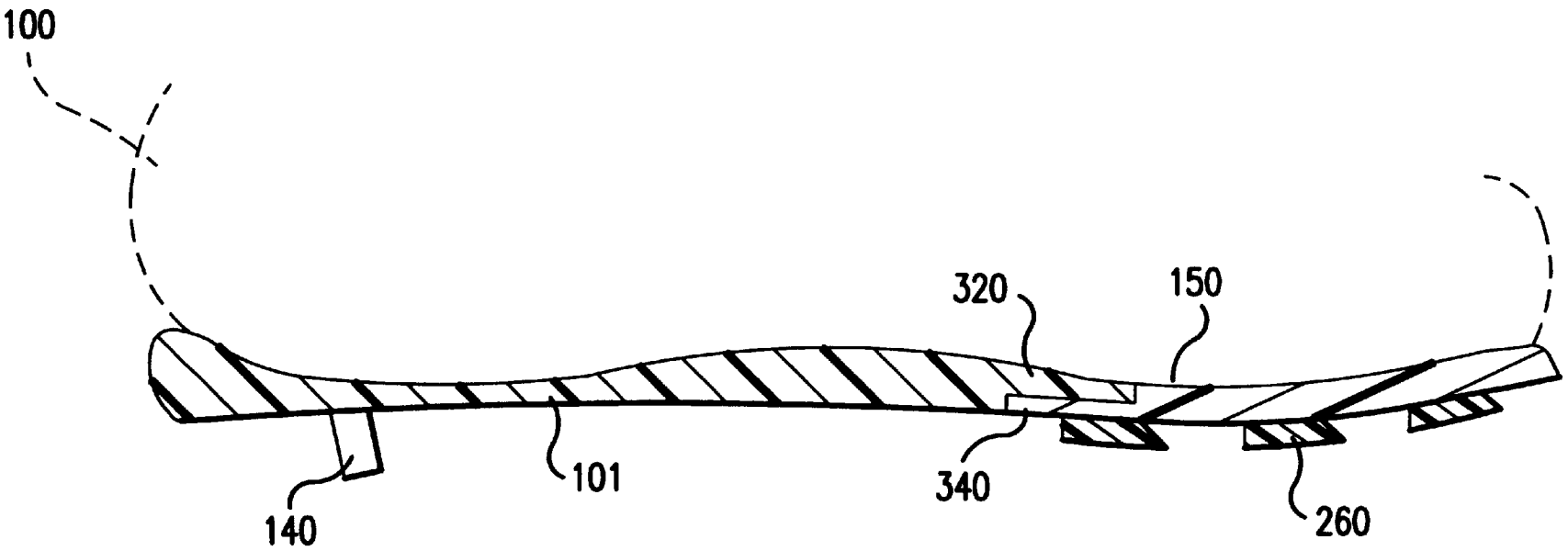
FIG. 12 is a side view of a rigid midsole containing multiple studs for receiving a replaceable heel.
Figure 13:
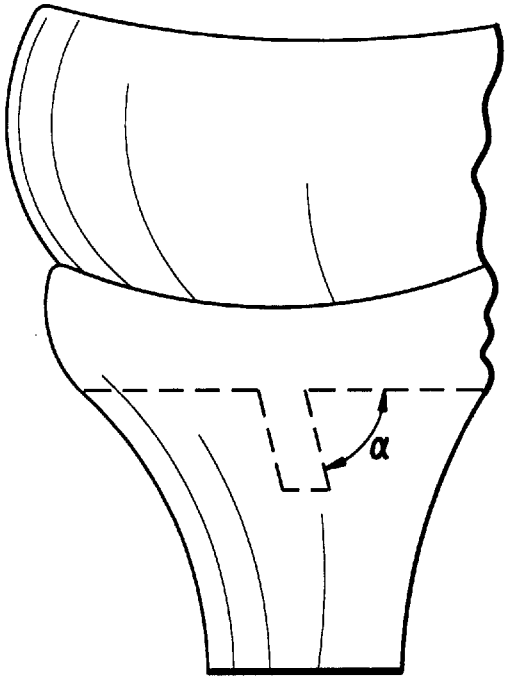
FIGS. 13 and 14 illustrate a multiple stud angle concept used with a rigid midsole of the invention.
Figure 14:
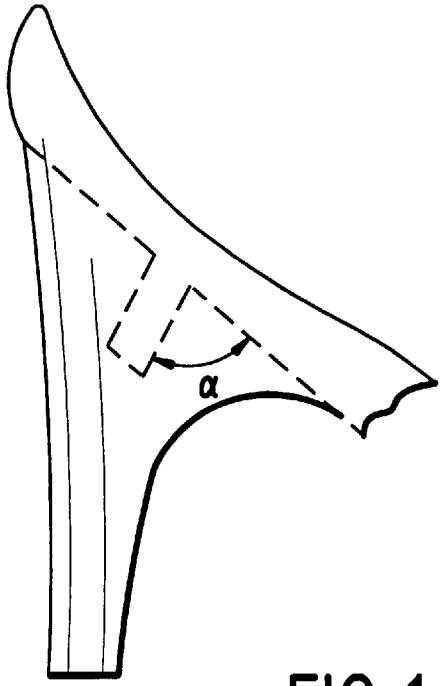
Figure 1:
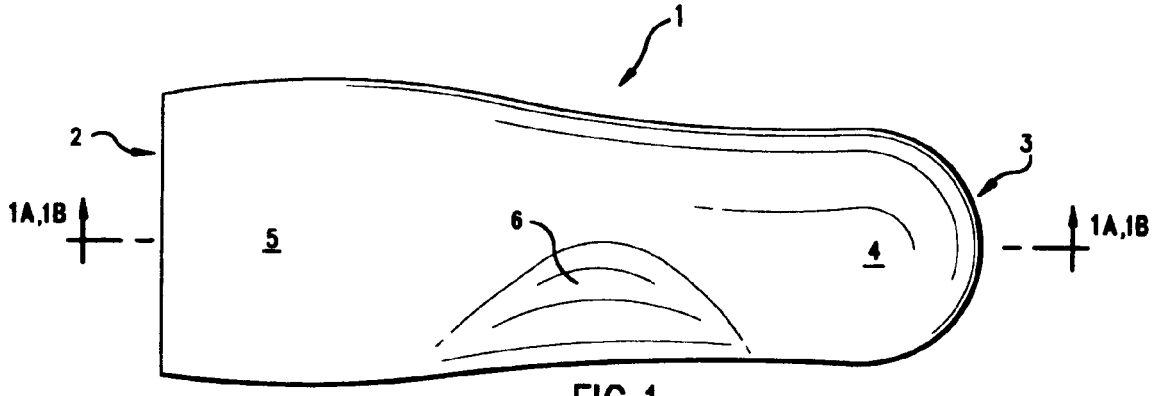
Figure 1A:
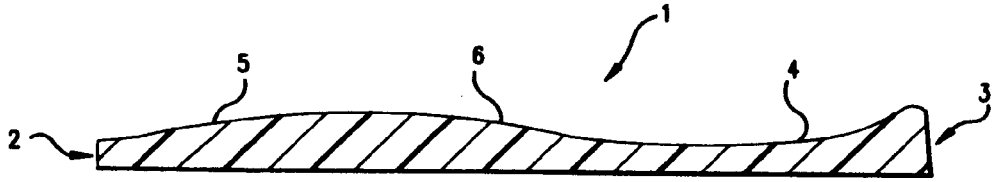
Figure 2:
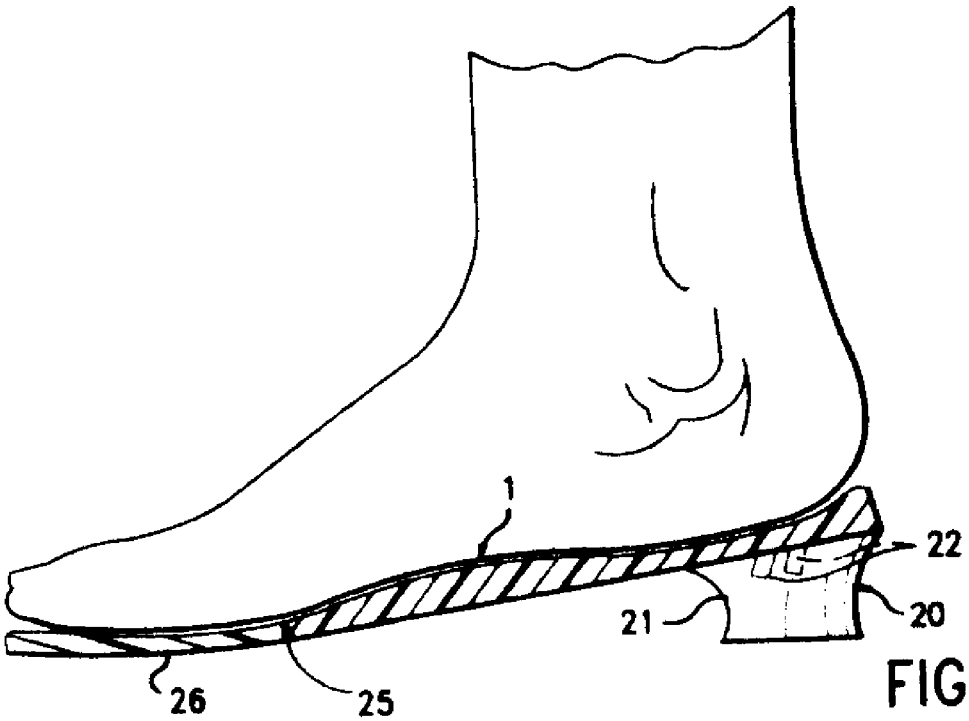
Figure 3:
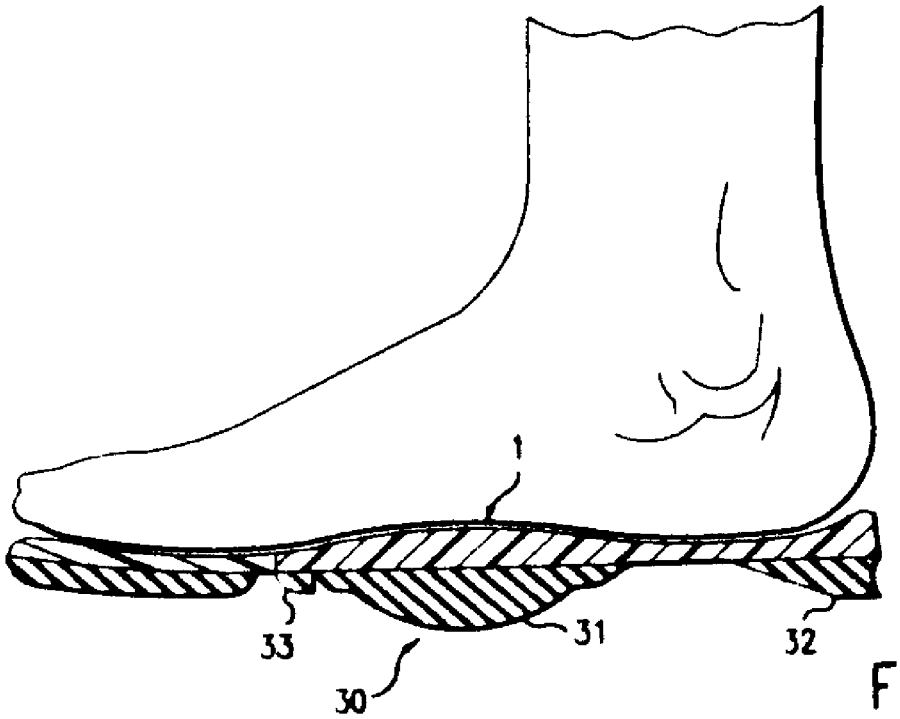
Figure 4:
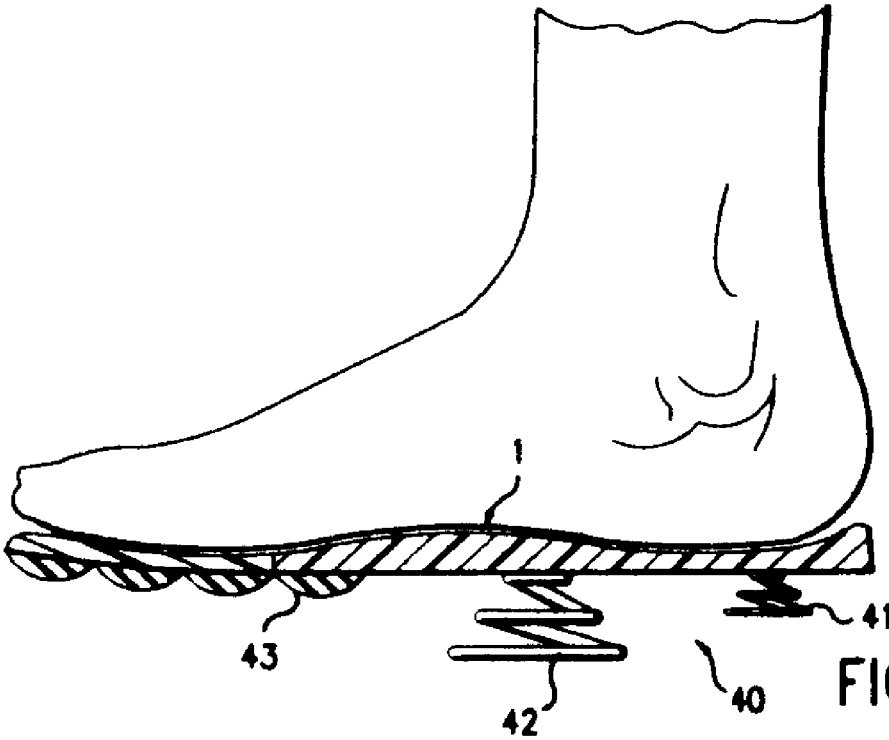
Figure 5:
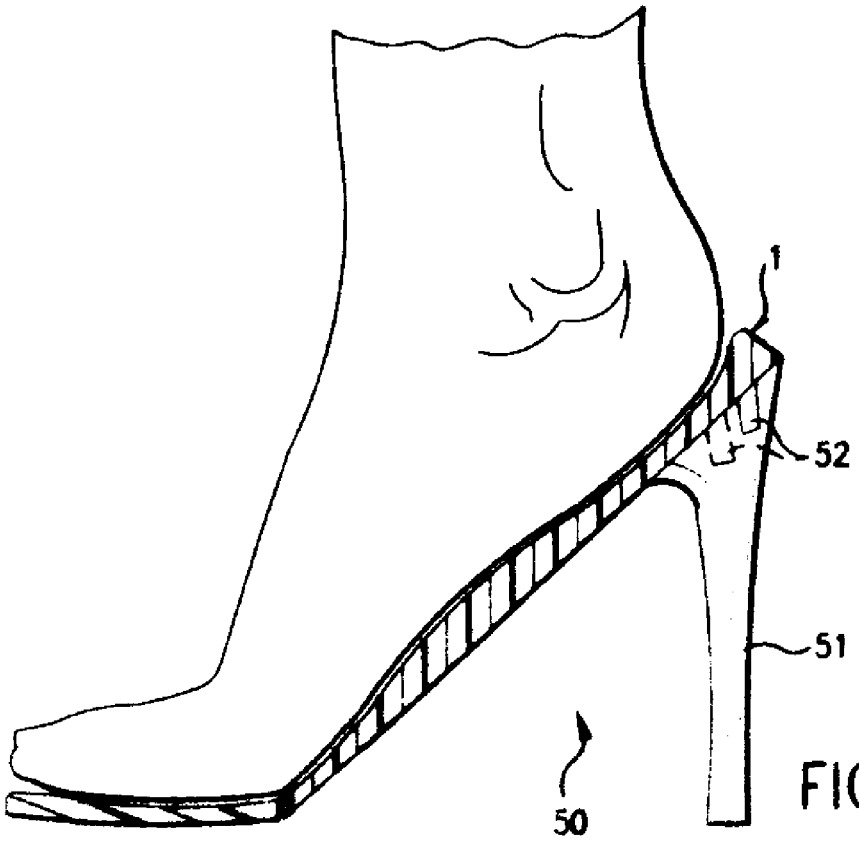
Figure 8:
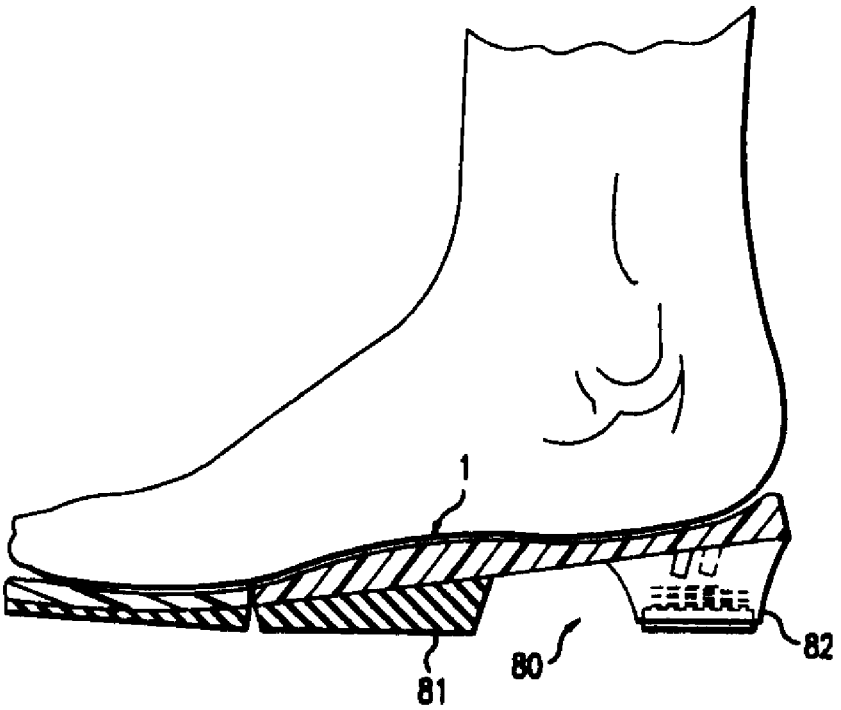
Figure 9:
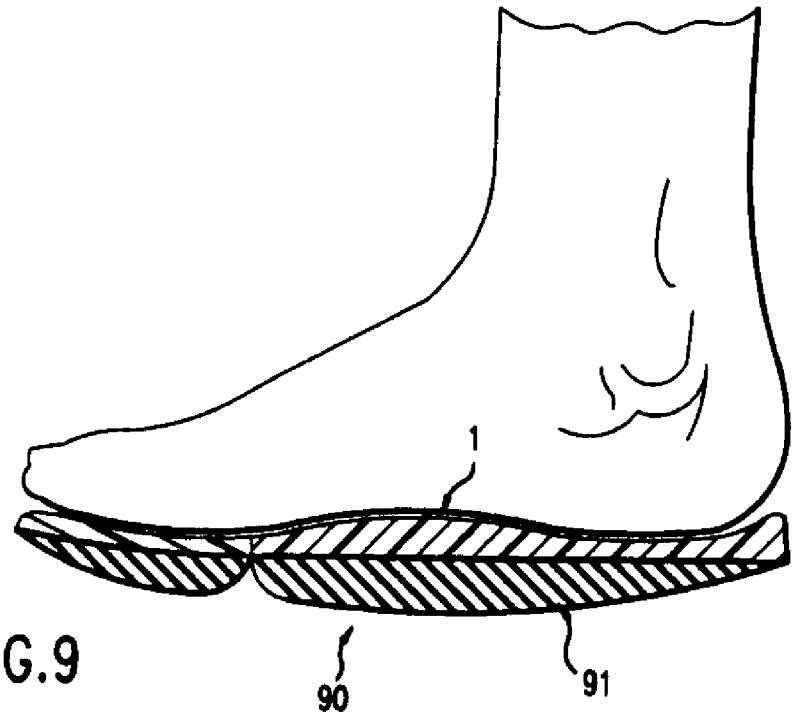
Figure 10:
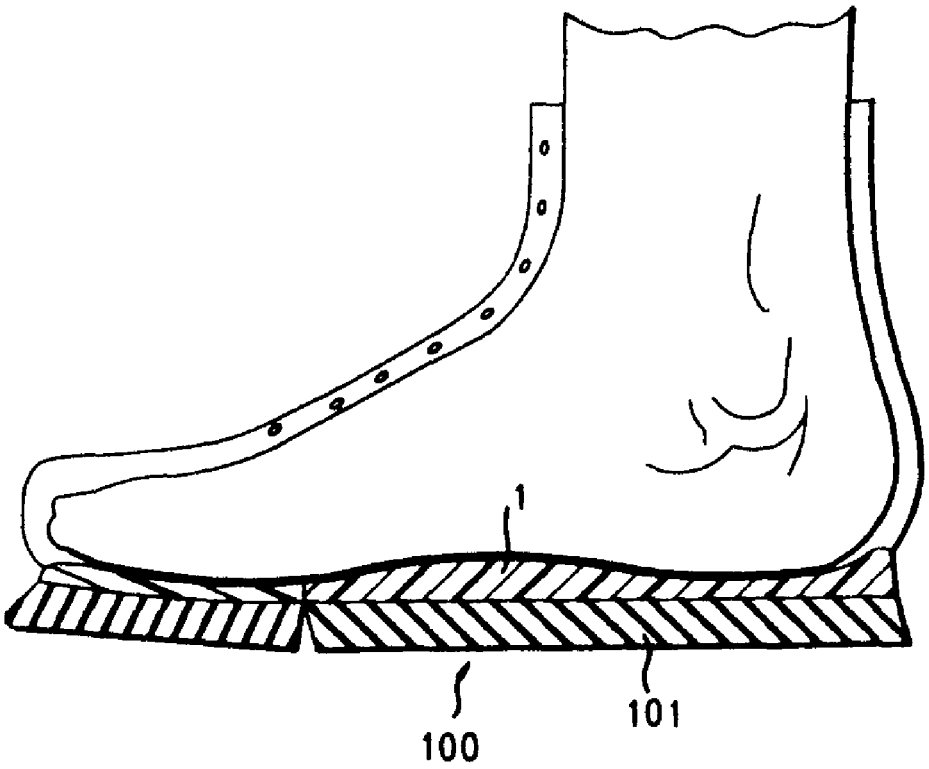
Figure 11:
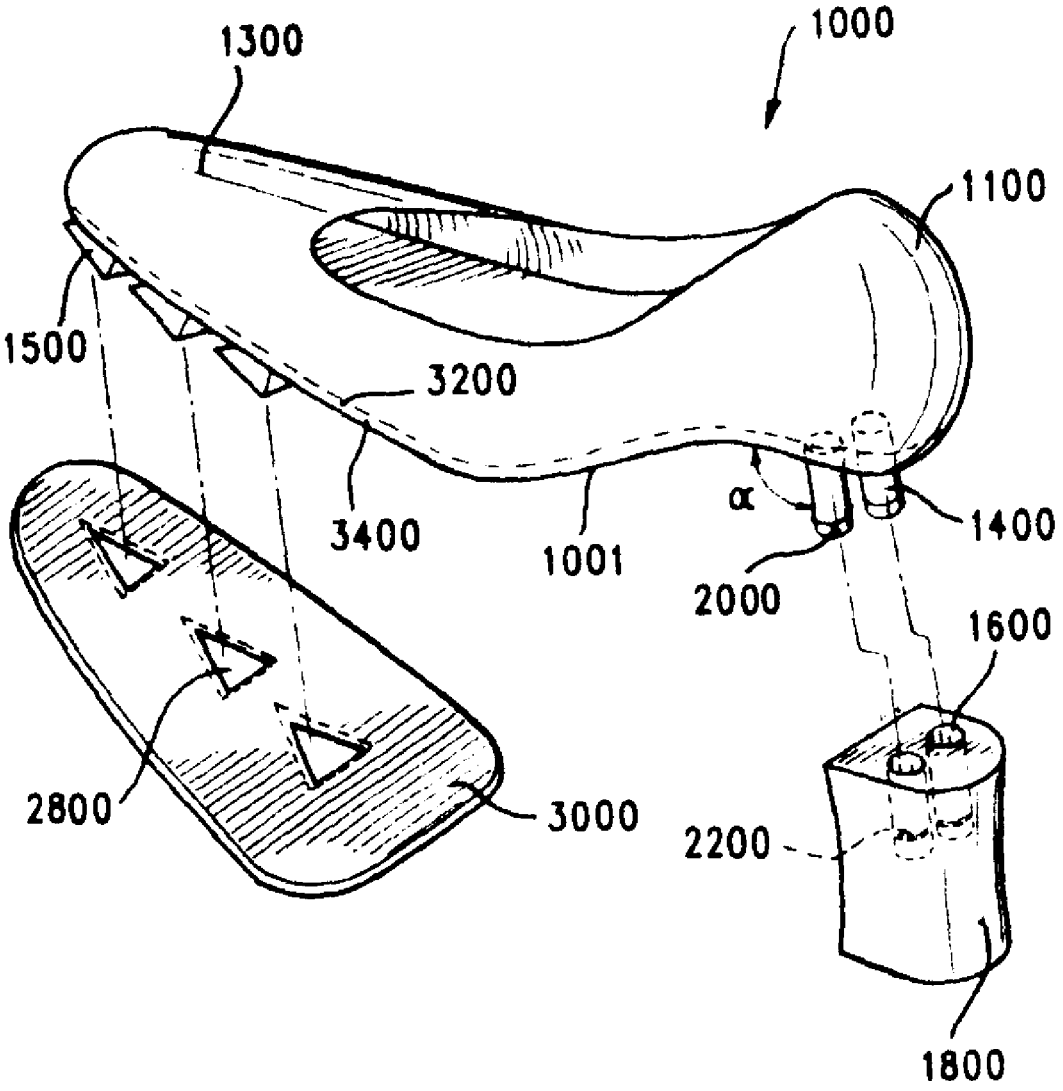
Figure 12:
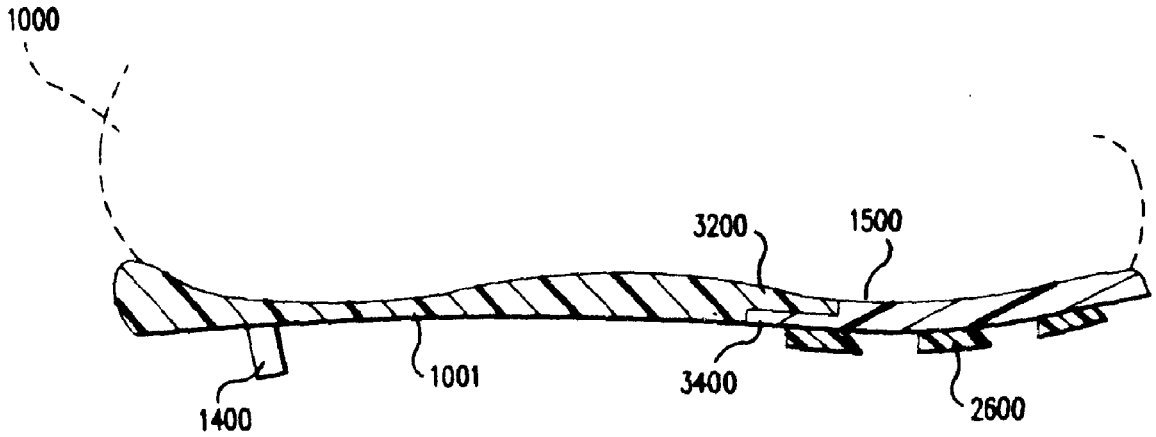

Referring to FIG. 12, heel support portion 1001 is preferably formed of a stiff material such as lexan plastic or an equivalent, and toe support portion 1500 is preferably formed of a flexible material such as rubber or a similar sturdy flexible material. Toe support portion 1500 and heel support portion 1001 are stepped relative to one another in corresponding stepped portions 3200, 3400, respectively, and are fixed to one another in any suitable manner such as by glue.

Preferably, toe support portion 1500 of front area 1300 has fixed thereon a plurality of frustoconical shaped wedges 2600. Wedges 2600 can be integral with a support plate (not shown) fixed to toe support portion 1500 or they can be attached directly to toe support portion 1500 in any suitable manner such as by integral molding or by glue. Wedges 2600 are adapted to be received in correspondingly frustoconical shaped wedge receiving apertures 2800 of a removable sole 3000.

To attach the sole to the shoe, the front portions of wedges 2600 are inserted into the wider rear portions of apertures 2800 and are slid forward into engagement. This arrangement provides for ready interchangeability of a variety of soles to accommodate various activities and functions.

While the embodiments disclosed are preferred, it will be appreciated from the disclosure that various alternatives, modifications, variations or improvements therein may be made by those skilled in the art that are within the scope of the invention, which is defined by the following claims.

What is claimed is:

1. A midsole assembly for use in footwear, the midsole assembly comprising:

a rigid piece extending substantially from a metatarsal area of a wearer's foot to a rear area of the foot, the rigid piece extending at least approximately two-thirds of a total horizontal length of the midsole assembly as measured from a toe area of the foot to the rear area of the foot so as to support the metatarsal area of the foot;

a flexible forefront piece extending from the toe area of a wearer's foot to the metatarsal area of a wearer's foot, the flexible forefront piece overlapping a portion of the rigid piece to form a hinge area; and attaching means for removably attaching a removable undercarriage to the rigid piece, the attaching means being positioned on a bottom surface of the rigid piece.

2. The midsole assembly according to claim 1, wherein the rigid piece has an upper surface and a lower surface, the upper surface including a depression region for a heel of the wearer, a raised region to support an arch of the wearer, and an inclined region sloping from the arch to the metatarsal area of the wearer's foot.

3. The midsole assembly according to claim 1, further comprising a separate, contoured foot support attached to the rigid piece, an upper surface of the foot support including a depression region for a heel of the wearer, a raised region to support an arch of the wearer, and an inclined region sloping from the arch to the metatarsal area of the wearer's foot.

4. The midsole assembly according to claim 1, wherein the rigid piece is constructed from a material selected from the group consisting of plastic; hardened natural rubber; hardened synthetic rubber; metal; reinforced polymers; composite materials; and a combination thereof.

5. The midsole assembly according to claim 1, wherein the attaching means is selected from the group consisting of a stud and aperture connection; a wedge and aperture connection; velcro; fasteners; magnets; adhesives; and a combination thereof.

6. The midsole assembly according to claim 1, further comprising a removable undercarriage, wherein the removable undercarriage comprises a single undercarriage component.

7. The midsole assembly according to claim 6, wherein the single undercarriage component is selected from the group consisting of a heel; a flexible, resilient sole; a spring-type structure; a flexible resilient structure; and a combination thereof.

8. The midsole assembly according to claim 1, further comprising a removable undercarriage, wherein the removable undercarriage comprises a multi-component undercarriage.

9. The midsole assembly according to claim 8, wherein the multi-component undercarriage is selected from the group consisting of a heel; a flexible, resilient sole; a spring-type structure; a flexible resilient structure; and a combination thereof.

10. The assembly of claim 1, wherein the shape of the rigid piece provides means for allowing selective attachment thereto of removable undercarriages of varying heights.

11. A midsole assembly for use in footwear, the midsole assembly comprising:

a rigid piece extending substantially from a metatarsal area of a wearer's foot to a rear area of the foot, the rigid piece extending at least approximately two-thirds of a total horizontal length of the midsole assembly as measured from a toe area of the foot to the rear area of the foot so as to support the metatarsal area of the foot;

a flexible forefront piece extending from the toe area of a wearer's foot to the metatarsal area of a wearer's foot, the flexible forefront piece overlapping a portion of the rigid piece to form a hinge area; and a removable undercarriage and attaching means for removably attaching the removable undercarriage to the rigid piece, the attaching means being positioned on a bottom surface of the rigid piece.

12. The midsole assembly according to claim 11, wherein the rigid piece has an upper surface and a lower surface, the upper surface including a depression region for a heel of the wearer, a raised region to support an arch of the wearer, and an inclined region sloping from the arch to the metatarsal area of the wearer's foot.

13. The midsole assembly according to claim 11, further comprising a separate, contoured foot support attached to the rigid piece, an upper surface of the foot support including a depression region for a heel of the wearer, a raised region to support an arch of the wearer, and an inclined region sloping from the arch to the metatarsal area of the wearer's foot.

14. The footwear according to claim 11, wherein the rigid piece is constructed from a material selected from the group consisting of plastic; hardened natural rubber; hardened synthetic rubber; metal; reinforced polymers; composite materials; and a combination thereof.

15. The footwear according to claim 11, wherein the attaching means is selected from the group consisting of a stud and aperture connection; a wedge and aperture connection; velcro; fasteners; magnets; adhesives; and a combination thereof.

16. The footwear according to claim 11, wherein the removable undercarriage comprises a single undercarriage component.

17. The footwear according to claim 16, wherein the removable undercarriage is selected from the group consisting of a heel; a flexible, resilient sole; a spring-type structure; a flexible, resilient structure; and a combination thereof.

18. The footwear according to claim 11, wherein the removable undercarriage comprises a multi-component undercarriage.

19. The footwear according to claim 18, wherein the removable undercarriage is selected from the group consisting of a heel; a flexible, resilient sole; a spring-type structure; a flexible, resilient structure; and a combination thereof.

20. The assembly of claim 11, wherein the shape of the rigid piece provides means for allowing selective attachment thereto of removable undercarriages of varying heights.

21. A midsole assembly for use in footwear, the midsole assembly comprising:

a rigid piece extending substantially from a metatarsal area of a wearer's foot to a rear area of the foot, the rigid piece extending at least approximately two-thirds of a total horizontal length of the midsole assembly as measured from a toe area of the foot to the rear area of the foot so as to support the metatarsal area of the foot; and attaching means for removably attaching a removable undercarriage to the rigid piece, the attaching means being positioned on a bottom surface of the rigid piece at an angle of 60° to 80° with respect to the bottom surface of the rigid piece.

22. The midsole assembly of claim 21, wherein the attaching means is at least one stud positioned on a bottom surface of the rigid piece at an angle of 60° to 80° with respect to the bottom surface of the rigid piece.

23. The midsole assembly of claim 22, wherein the at least one stud is positioned at an angle of 70° with respect to the bottom surface of the rigid piece.

24. The assembly of claim 21, wherein the shape of the rigid piece provides means for allowing selective attachment thereto of removable undercarriages of varying heights.

25. A midsole assembly for use in footwear, the midsole assembly comprising:

a rigid piece extending substantially from a metatarsal area of a wearer's foot to a rear area of the foot, the rigid piece extending at least approximately two-thirds of a total horizontal length of the midsole assembly as measured from a toe area of the foot to the rear area of the foot so as to support the metatarsal area of the foot;

a removable undercarriage;

at least one stud positioned on a bottom surface of the rigid piece;

at least one aperture formed in the removable undercarriage; and means for snappingly engaging the at least one stud with the at least one aperture to removably attach the removable undercarriage to the rigid piece.

26. The midsole assembly of claim 25, wherein the at least one stud is molded integrally with the rigid piece.

27. The midsole assembly of claim 25, wherein the means for snappingly engaging comprises at least one ridge member which engages with at least one radial protrusion in the at least one aperture.

28. The assembly of claim 25, wherein the shape of the rigid piece provides means for allowing selective attachment thereto of removable undercarriages of varying heights.

29. A midsole assembly for use in footwear, the midsole assembly comprising:

a rigid piece have a central longitudinal axis and extending substantially from a metatarsal area of a wearer's foot to a rear area of the foot, the central longitudinal axis of the rigid piece being substantially planar;

a flexible forefront piece extending from the toe area of a wearer's foot to the metatarsal area of a wearer's foot, the flexible forefront piece overlapping a portion of the rigid piece to form a hinge area; and attaching means for removably attaching a removable undercarriage to the rigid piece, the attaching means being positioned on a bottom surface of the rigid piece.

30. The assembly of claim 29, wherein the shape of the rigid piece provides means for allowing selective attachment thereto of removable undercarriages of varying heights.

31. The midsole assembly according to claim 29, wherein the rigid piece has an upper surface and a lower surface, the upper surface including a depression region for a heel of the wearer, a raised region to support an arch of the wearer, and an inclined region sloping from the arch to the metatarsal area of the wearer's foot.

32. The midsole assembly according to claim 29, further comprising a separate, contoured foot support attached to the rigid piece, an upper surface of the foot support including a depression region for a heel of the wearer, a raised region to support an arch of the wearer, and an inclined region sloping from the arch to the metatarsal area of the wearer's foot.

33. The midsole assembly according to claim 29, wherein the rigid piece is constructed from a material selected from the group consisting of plastic; hardened natural rubber; hardened synthetic rubber; metal; reinforced polymers; composite materials; and a combination thereof.

34. The midsole assembly according to claim 29, wherein the attaching means is selected from the group consisting of a stud and aperture connection; a wedge and aperture connection; velcro; fasteners; magnets; adhesives; and a combination thereof.

35. The midsole assembly according to claim 29, wherein the removable undercarriage comprises a single undercarriage component.

36. The midsole assembly according to claim 35, wherein the single undercarriage component is selected from the group consisting of a heel; a flexible, resilient sole; a spring-type structure; a flexible resilient structure; and a combination thereof.

37. The midsole assembly according to claim 29, wherein the removable undercarriage comprises a multi-component undercarriage.

38. The midsole assembly according to claim 37, wherein the multi-component undercarriage is selected from the group consisting of a heel; a flexible, resilient sole; a spring-type structure; a flexible resilient structure; and a combination thereof.

39. A midsole assembly for use in footwear, the midsole assembly comprising:

a rigid piece have a central longitudinal axis and extending substantially from a metatarsal area of a wearer's foot to a rear area of the foot, the central longitudinal axis of the rigid piece being substantially planar;

a flexible forefront piece extending from the toe area of a wearer's foot to the metatarsal area of a wearer's foot, the flexible forefront piece overlapping a portion of the rigid piece to form a hinge area; and a removable undercarriage and attaching means for removably attaching the removable undercarriage to the rigid piece, the attaching means being positioned on a bottom surface of the rigid piece.

40. The midsole assembly according to claim 39, wherein the rigid piece has an upper surface and a lower surface, the upper surface including a depression region for a heel of the wearer, a raised region to support an arch of the wearer, and an inclined region sloping from the arch to the metatarsal area of the wearer's foot.

41. The midsole assembly according to claim 39, further comprising a separate, contoured foot support attached to the rigid piece, an upper surface of the foot support including a depression region for a heel of the wearer, a raised region to support an arch of the wearer, and an inclined region sloping from the arch to the metatarsal area of the wearer's foot.

42. The midsole assembly according to claim 39, wherein the rigid piece is constructed from a material selected from the group consisting of plastic; hardened natural rubber; hardened synthetic rubber; metal; reinforced polymers; composite materials; and a combination thereof.

43. The midsole assembly according to claim 39, wherein the attaching means is selected from the group consisting of a stud and aperture connection; a wedge and aperture connection; velcro; fasteners; magnets; adhesives; and a combination thereof.

44. The midsole assembly according to claim 39, wherein the removable undercarriage comprises a single undercarriage component.

45. The midsole assembly according to claim 39, wherein the removable undercarriage comprises a multi-component undercarriage.

46. The midsole assembly according to claim 45, wherein the removable undercarriage is selected from the group consisting of a heel; a flexible, resilient sole; a spring-type structure; a flexible resilient structure; and a combination thereof.

47. The midsole assembly according to claim 44, wherein the removable undercarriage is selected from the group consisting of a heel; a flexible, resilient sole; a spring-type structure; a flexible resilient structure; and a combination thereof.

48. The assembly of claim 39, wherein the shape of the rigid piece provides means for allowing selective attachment thereto of removable undercarriages of varying heights.

* * * * *

UNITED STATES PATENT AND TRADEMARK OFFICE

CERTIFICATE OF CORRECTION

PATENT NO. : 5,970,630
DATED : October 26, 1999
INVENTOR(S) : Alvaro Z. Gallegos It is certified that error appears in the above-identified patent and that said Letters Patent is hereby corrected as shown below:

Claim 10, line 1, before "assembly" insert --midsole--.

Claim 14, line 1, change "footwear" to --midsole assembly--.

Claim 15, line 1, change "footwear" to --midsole assembly--.

Claim 16, line 1, change "footwear" to --midsole assembly--.

Claim 17, line 1, change "footwear" to --midsole assembly--.

Claim 18, line 1, change "footwear" to --midsole assembly--.

Claim 19, line 1, change "footwear" to --midsole assembly--.

Claim 20, line 1, before "assembly" insert --midsole--.

Claim 24, line 1, before "assembly" insert --midsole--.

Claim 28, line 1, before "assembly" insert --midsole--.

Claim 30, line 1, before "assembly" insert --midsole--.

Claim 48, line 1, before "assembly" insert --midsole--.

Signed and Sealed this

Sixteenth Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,970,630
APPLICATION NO. : 08/712643
DATED : October 26, 1999
INVENTOR(S) : Alvaro Gallegos It is certified that error appears in the above-identified patent and that said Letters Patent is hereby corrected as shown below:

The title page should be deleted to appear as per attached title page.

The sheets of drawings consisting of figures 1-5 and figures 8-12 should be deleted to appear as per attached figures.

Claim 10, line 1, before "assembly" insert --midsole--.

Claim 14, line 1, change "footwear" to --midsole assembly--.

Claim 15, line 1, change "footwear" to --midsole assembly--.

Claim 16, line 1, change "footwear" to --midsole assembly--.

Claim 17, line 1, change "footwear" to --midsole assembly--.

Claim 18, line 1, change "footwear" to --midsole assembly--.

Claim 19, line 1, change "footwear" to --midsole assembly--.

Claim 20, line 1, before "assembly" insert --midsole--.

Claim 24, line 1, before "assembly" insert --midsole--.

Claim 28, line 1, before "assembly" insert --midsole--.

Claim 30, line 1, before "assembly" insert --midsole--.

UNITED STATES PATENT AND TRADEMARK OFFICE

CERTIFICATE OF CORRECTION

PATENT NO. : 5,970,630
APPLICATION NO. : 08/712643
DATED : October 26, 1999
INVENTOR(S) : Alvaro Gallegos It is certified that error appears in the above-identified patent and that said Letters Patent is hereby corrected as shown below:

Claim 48, line 1, before "assembly" insert --midsole--.

Signed and Sealed this

Seventeenth Day of October, 2006

JON W. DUDAS
*Director of the United States Patent and Trademark Office*

United States Patent [19]

Gallegos

[11] Patent Number: 5,970,630

[45] **Date of Patent: *Oct. 26, 1999**

[54] RIGID MIDSOLE FOOTWARE STRUCTURE WITH REMOVABLE UNDERCARRIAGE ATTACHING MEANS

[76] Inventor: Alvaro Z. Gallegos, Rte. 9 - Box 160, Santa Fe, N.Mex. 87505

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,643

[22] Filed: Sep. 11, 1996

Related U.S. Application Data

[63] Continuation-in-part of application No. 08/428,840, Apr. 25, 1995, abandoned, which is a continuation-in-part of application No. 08/178,839, Jan. 7, 1994, abandoned.

[51] Int. Cl.[6] ..... A43B 3/24; A43B 21/36; A43C 13/00

[52] U.S. Cl. ..... 36/100; 36/15; 36/36 R; 36/42; 36/36 B; 36/102

[58] Field of Search ..... 36/15, 30 R, 31, 36/100, 101, 36 R, 42, 36 B, 102, 92, 93, 88

[56] References Cited

U.S. PATENT DOCUMENTS

| | | | |
|---|---|---|---|
| 1,341,387 | 5/1920 | Schrade . | |
| 1,506,315 | 8/1924 | Lywitzki . | |
| 1,986,727 | 1/1935 | Hall, Jr. | 36/36 B |
| 2,168,606 | 8/1939 | Movsesian | 36/42 |
| 2,239,600 | 4/1941 | Fogarty . | |
| 2,345,551 | 4/1944 | Audino | 36/31 |
| 2,361,511 | 10/1944 | Stritter | 36/31 |
| 2,707,341 | 5/1955 | Romano . | |
| 2,734,288 | 2/1956 | Phillips et al. . | |
| 2,760,280 | 8/1956 | Carlin . | |
| 2,837,841 | 6/1958 | Twedt . | |
| 2,873,540 | 2/1959 | Murphy . | |
| 3,199,233 | 8/1965 | Steinbock | 36/93 |
| 3,318,025 | 5/1967 | Antelo . | |
| 3,389,481 | 6/1968 | England . | |
| 3,432,945 | 3/1969 | Cesta . | |
| 3,464,126 | 9/1969 | Sarkissian . | |
| 3,478,447 | 11/1969 | Gillead | 36/36 B |
| 3,608,213 | 9/1971 | Jensen . | |
| 3,646,497 | 2/1972 | Gillikin . | |
| 3,952,429 | 4/1976 | Thomas | 36/31 |
| 3,975,839 | 8/1976 | Taber . | |
| 3,982,336 | 9/1976 | Herro . | |
| 4,020,569 | 5/1977 | Fukuoka | 36/30 R |
| 4,124,946 | 11/1978 | Tomlin | 36/30 R |
| 4,214,384 | 7/1980 | Gonzalez . | |
| 4,348,821 | 9/1982 | Daswick | 36/30 R |
| 4,400,893 | 8/1983 | Musci . | |
| 4,409,745 | 10/1983 | Musci . | |
| 4,494,323 | 1/1985 | Latraverse . | |
| 4,510,702 | 4/1985 | Ehrlich, Jr. | 36/31 |
| 4,610,100 | 9/1986 | Rhodes . | |
| 4,805,320 | 2/1989 | Goldenberg et al. . | |
| 5,025,574 | 6/1991 | Lasher, III . | |
| 5,058,290 | 10/1991 | Koehl et al. . | |
| 5,133,138 | 7/1992 | Durcho . | |
| 5,347,730 | 9/1994 | Colon . | |
| 5,373,650 | 12/1994 | Dananberg et al. | 36/92 |
| 5,410,820 | 5/1995 | Goodman . | |
| 5,423,134 | 6/1995 | Bagnaia et al. | 36/101 |

FOREIGN PATENT DOCUMENTS

| | | | |
|---|---|---|---|
| 1059488 | 3/1954 | France . | |
| 1633161 | 12/1989 | France | 36/101 |
| 125350 | 4/1949 | Switzerland | 36/15 |

*Primary Examiner*—M. D. Patterson
*Attorney, Agent, or Firm*—Oliff & Berridge, PLC

[57] ABSTRACT

A rigid midsole structure for footwear extends from the metatarsal area to a rear-most portion proximate the heel of a wearer. The rigid midsole accepts any form of replaceable undercarriage structure, and includes means for attaching the undercarriage structure to the bottom side of the rigid midsole. The rigid midsole is preferably formed with an upper surface configured to conform with the bottom of a wearer's foot to provide sufficient rigidity and comfort.

48 Claims, 10 Drawing Sheets

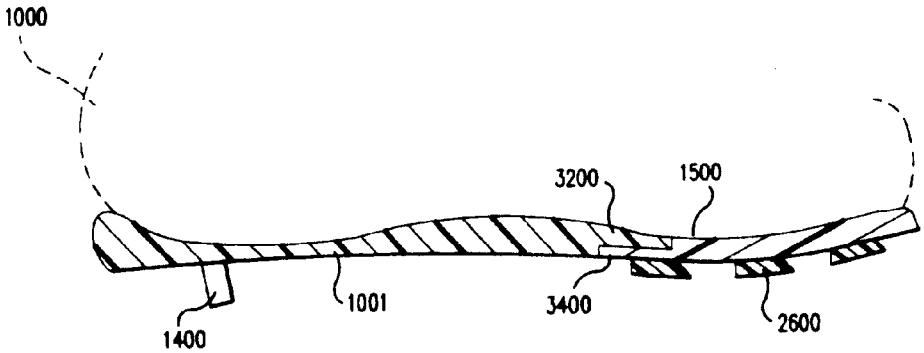

U.S. Patent Oct. 26, 1999 Sheet 1 of 10 5,970,630